US008083374B2

(12) United States Patent
Mo et al.

(10) Patent No.: US 8,083,374 B2
(45) Date of Patent: Dec. 27, 2011

(54) LED LAMP

(75) Inventors: Ci-Jin Mo, Shenzhen (CN); Chin-Chung Chen, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 112 days.

(21) Appl. No.: 12/749,483

(22) Filed: Mar. 29, 2010

(65) Prior Publication Data

US 2011/0133622 A1 Jun. 9, 2011

(30) Foreign Application Priority Data

Dec. 4, 2009 (CN) ..... 2009 1 0310946

(51) Int. Cl.
*F21V 21/00* (2006.01)

(52) U.S. Cl. ..... 362/249.02; 362/249.01; 362/294; 362/373; 362/545; 362/547

(58) Field of Classification Search ..... 362/227, 362/234, 249.01–249.02, 294, 373, 382, 362/543–547, 800
See application file for complete search history.

(56) References Cited

U.S. PATENT DOCUMENTS

2006/0193130 A1* 8/2006 Ishibashi ..... 362/227
2009/0175041 A1* 7/2009 Yuen et al. ..... 362/294

* cited by examiner

*Primary Examiner* — Stephen F Husar
*Assistant Examiner* — Meghan Dunwiddie
(74) *Attorney, Agent, or Firm* — Altis Law Group, Inc.

(57) ABSTRACT

An LED lamp includes a heat sink including a supporting plate, a plurality of LEDs mounted on the supporting plate and a plurality of protruding blocks extending upwardly from a top face of the supporting plate. The protruding blocks have inclined faces oriented upwardly and outwardly away from the top face of the supporting plate. The LEDs includes a plurality of first LEDs disposed on a bottom face of the supporting plate and a plurality of second LEDs disposed on the inclined faces of the protruding blocks, whereby at least a portion of light generated from the second LEDs projects towards a lateral side of the LED lamp.

14 Claims, 3 Drawing Sheets

LED LAMP

BACKGROUND

1. Technical Field

The disclosure relates to LED (light emitting diode) lamps for illumination purpose and, more particularly, relates to an improved LED lamp having a large illumination area.

2. Description of Related Art

An LED lamp is a type of solid-state lighting that utilizes LEDs as a source of illumination. An LED is a device for transferring electricity to light by using a theory that, if a current is made to flow in a forward direction through a junction region comprising two different semiconductors, electrons and holes are coupled at the junction region to generate a light beam. The LED has an advantage that it is resistant to shock, and has an almost eternal lifetime under a specific condition; thus, the LED lamp is intended to be a cost-effective yet high quality replacement for incandescent and fluorescent lamps.

Since LED lamps have many advantages; they are now used as street lamps, lawn lamps or home lamps for illumination purpose. Known implementations of an LED module in the LED lamp make use of a plurality of individual LEDs to generate light that is ample and of satisfactory spatial distribution. The large numbers of LEDs, however, increase price and power consumption of the module. Considerable heat is also generated, which, if not adequately addressed at additional expense, impacts the reliability of the LED lamp.

Further, since the LEDs are generally arranged on a printed circuit board having a flattened face, light emitted from the LEDs is concentrated on a small area confronting the LEDs due to high directivity of the LEDs, which is unsuitable for environments requiring an even and broad illumination. Thus, the LEDs mounted on the flattened face of the printed circuit board cannot have a large area of illumination.

What is needed, therefore, is an improved LED lamp which can overcome the above problems.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
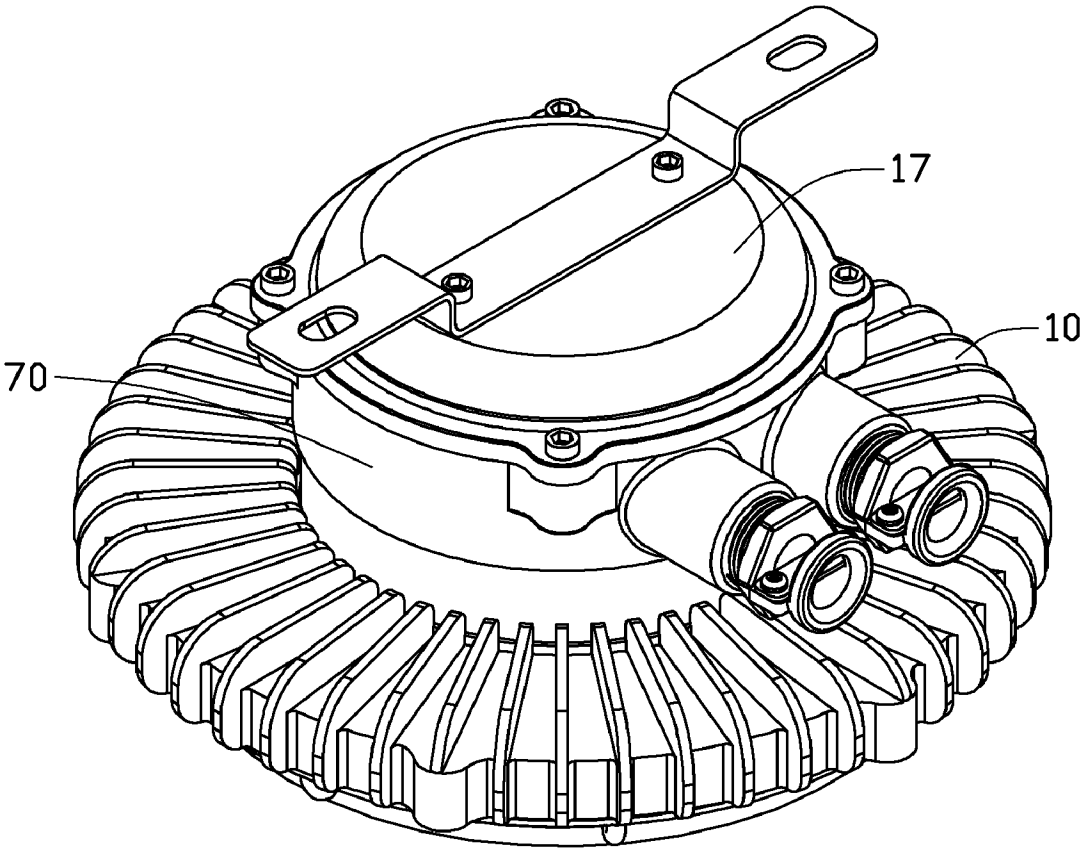
FIG. 1 is an isometric, assembled view of an LED lamp in accordance with an embodiment of the disclosure.
Figure 2:
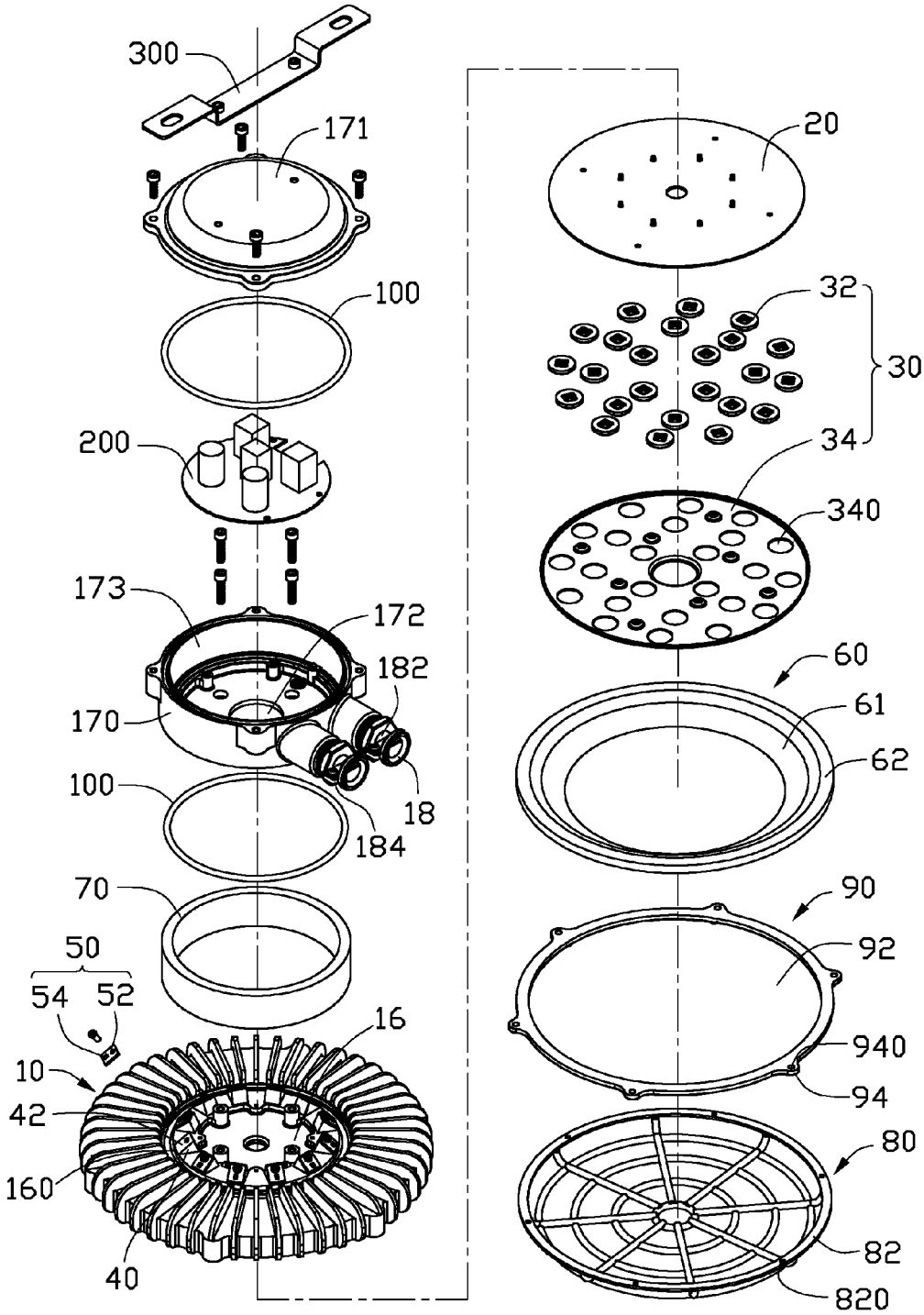
FIG. 2 is an exploded view of the LED lamp of FIG. 1.

Referring to FIGS. 1 and 2, a light emitting diode (LED) lamp in accordance with an embodiment of the disclosure is illustrated. The LED lamp comprises a heat sink 10, a first LED module 20 thermally attached to a bottom face of the heat sink 10, a light-guiding module 30 disposed on the first LED module 20, a plurality of protruding blocks 40 extending upwardly from a top face of the heat sink 10, a plurality of second LED modules 50 correspondingly attached on the protruding blocks 40, a first envelope 60 mounted on the bottom face of the heat sink 10 and correspondingly covering the first LED module 20 and the light-guiding module 30, a second envelope 70 mounted on the top face of the heat sink 10 and correspondingly enclosing the protruding blocks 40 and the second LED modules 50 therein, a pressing frame 90 securing the first envelope 60 to the heat sink 10 and a protecting cage 80 being secured to the pressing frame 90 to cover and protect the first envelope 60.

Figure 3:
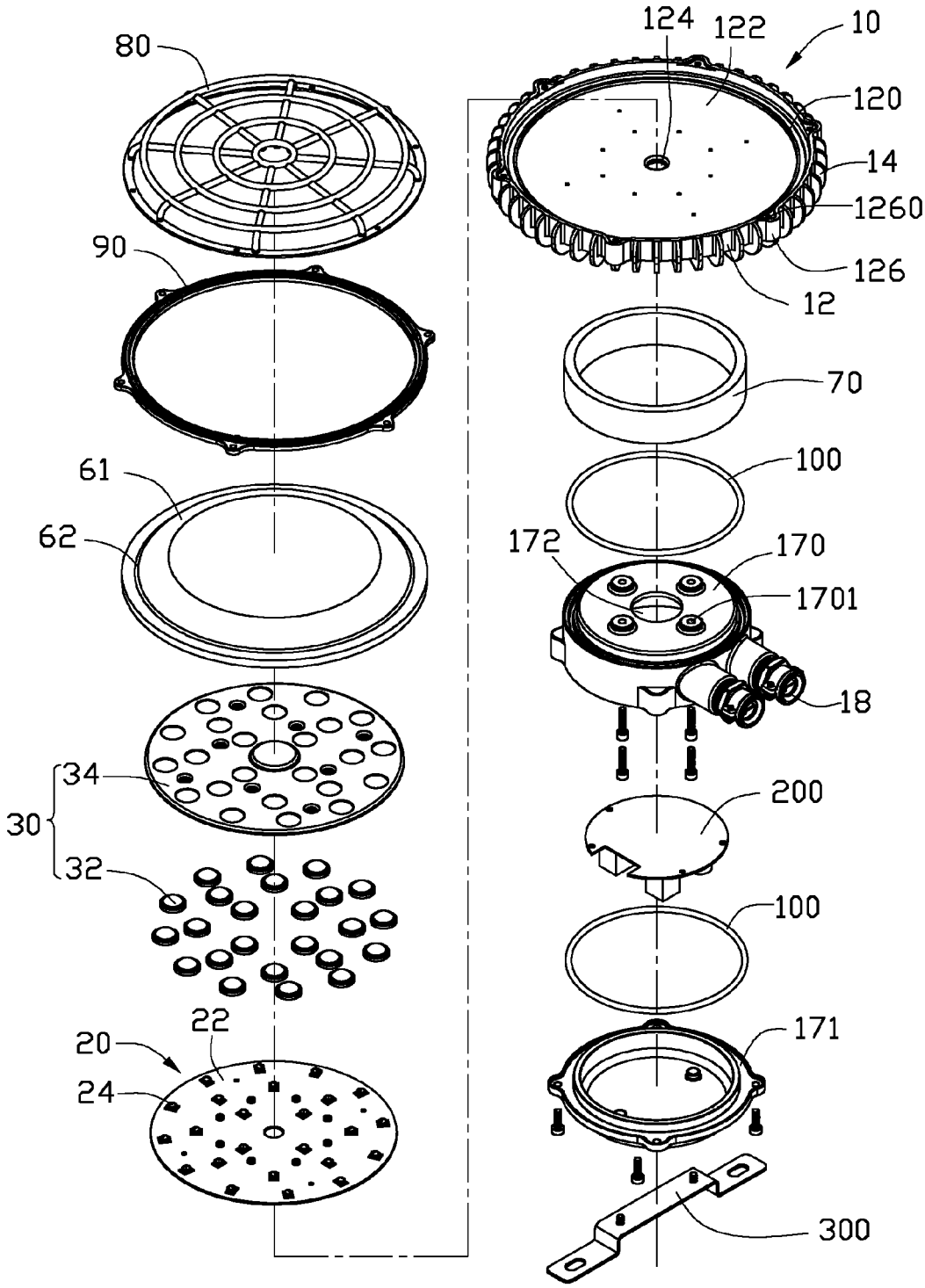
FIG. 3 is an inverted, exploded view of the LED lamp of FIG. 1.

Referring to FIG. 3 also, the heat sink 10 is integrally made of a metal with good heat conductivity such as aluminum, copper or an alloy thereof. The heat sink 10 comprises a circular supporting plate 12 and a plurality of fins 14 extending outwardly from a top and an outer circumference of the supporting plate 12. An annular receiving groove 120 is defined along an outer periphery of a bottom face of the supporting plate 12 for receiving an annular sealing gasket (not labeled) therein. The first envelope 60 is mounted on the bottom face of the supporting plate 12 with a periphery of the first envelope 60 engaging with the sealing gasket (not labeled) so that the first envelope 60 is hermetically connected to the supporting plate 12 of the heat sink 10. A circular mounting portion 122 is formed at a central area of the supporting plate 12 and surrounded by the receiving groove 120. A through hole 124 is defined in a center of the mounting portion 122 of the supporting plate 12 for extension of electrical wires (not shown) therethrough to electrically connect with the first LED module 20. A plurality of protruding ribs 126 protrude outwardly and perpendicularly from the outer circumference of the supporting plate 12. The protruding ribs 126 are equally spaced from each other. The protruding ribs 126 protrude radially outwardly and extend along a top-to-bottom direction of the supporting plate 12, and each have a semicircular cross-section along a horizontal direction. A screw hole 1260 is defined in a central portion of a bottom end of each protruding rib 126. An annular first groove 160 is defined in a top face of the supporting plate 12 for receiving an annular sealing cushion 100 therein. The first groove 160 is located generally equidistant from the through hole 124 and the outer circumference of the supporting plate 12. The first groove 160 is immediately inside of inner ends of the fins 14. The second envelope 70 is mounted on the top face of the supporting plate 12, with a periphery of the second envelope 70 engaging with the sealing cushion 100 whereby the second envelope 70 is hermetically connected to the supporting plate 12 of the heat sink 10. A circular engaging portion 16 is defined by the top face of the supporting plate 12 and surrounded by the first groove 160. The fins 14 are arranged radially relative to the engaging portion 16. A passage (not labeled) is defined between every two neighboring fins 14.

The protruding blocks 40 are arranged on an imaginary circle along an edge of the engaging portion 16. Each of the protruding blocks 40 is wedge-shaped and defines an inclined face 42 facing outwardly and upwardly, away from the supporting plate 12. In the embodiment of this disclosure, each of the protruding blocks 40 has a configuration like a triangular prism. An acute intersection angle is accordingly formed between the inclined face 42 and the top face of the supporting plate 12. The inclined faces 42 face radially and outwardly, and are centrosymmetrical relative to the through hole 124 of the supporting plate 12. Each of the inclined faces 42 of the protruding blocks 40 has one of the second LED modules 50 arranged thereon. The protruding blocks 40 are made of materials having high heat conductivity, such as copper (Cu) or its alloys to timely transfer heat generated by the second LED modules 50 to the heat sink 10 for dissipation. The protruding blocks 40 are integrally made with the supporting plate 12 in this embodiment. Accordingly, the heat sink 10 is entirely made of copper or copper alloy. Alternatively, the protruding blocks 40 can be separate structures attachablly mounted on the supporting plate 12, whereby the heat sink 10 can be made of aluminum or aluminum alloy which is cheaper than the copper and copper alloy.

The first LED module 20 comprises a circular first printed circuit board 22 and a plurality of first LEDs 24 mounted on the first printed circuit board 22. The first printed circuit board 22 is thermally attached on the bottom face of the supporting plate 12 of the heat sink 10, and the first LEDs 24 are arranged evenly on the printed circuit board 22 and spaced from each other. It is understood that the first printed circuit board 22 is a base which can support the first LEDs 24 and electrically connect the first LEDs 24 to a power supply.

The light-guiding module 30 comprises a plurality of lenses 32 each disposed on one of the first LEDs 24 of the first LED module 20 and a circular securing board 34 securing the lenses 32 to the first LED module 20. Each of the lenses 32 has a dome-like configuration. The securing board 34 defines a plurality of round fixing holes 340 for extension of the lenses 32 therethrough.

The first envelope 60 is integrally formed of a transparent or semitransparent material such as glass, resin or plastic. The first envelope 60 comprises a bowl-shaped body 61 and an engaging flange 62 extending outwardly and horizontally from a periphery of a top end of the body 61. The engaging flange 62 has a width larger than that of the receiving groove 120 of the supporting plate 12 and a diameter substantially the same as that of the receiving groove 120. When the first envelope 60 is connected to the heat sink 10, the engaging flange 62 covers the receiving groove 120, and the sealing gasket (not labeled) is sandwiched between the engaging flange 62 and the supporting plate 12 for increasing the sealing performance of the LED lamp.

The pressing frame 90 is annular and defines a hole 92 at a center thereof. A plurality of spaced protruding tabs 94 extend radially and outwardly from an outer periphery of the pressing frame 90. The pressing frame 90 has a diameter substantially equal to that of the engaging flange 62 of the first envelope 60. The protruding tabs 94 are evenly distributed along a circumference of the pressing frame 90. Each of the protruding tabs 94 is about semicircular-shaped, and defines a securing hole 940 at a center thereof. The securing holes 940 of the protruding tabs 94 are aligned with the protruding ribs 126 of the heat sink 10, respectively. Fasteners (not shown) are brought to extend through the securing holes 940 and threadedly engage in the protruding ribs 126 to thereby secure the pressing frame 90 to the heat sink 10, whereby the first envelope 60 is also securely mounted to the heat sink 10.

The protecting cage 80 has a shape corresponding to that of the first envelope 60, and has a size slightly larger than the first envelope 60. The protecting cage 80 comprises a plurality of wires (not labeled) interlaced with each other. The protecting cage 80 is configured as a bowl-shaped mesh having a plurality of openings between the wires. A pressing flange 82 extends horizontally and outwardly from a top end of the protecting cage 80. A plurality of apertures 820 are defined along a circumference of the pressing flange 82. Fasteners (not shown) are extended through the apertures 820 into the pressing frame 90 to secure the protecting cage 80 to the pressing frame 90; thus, the bowl-shaped body 61 of the first envelope 60 is protected by the protecting cage 80.

Each of the second LED modules 50 comprises a square second printed circuit board 52 and at least a second LED 54 mounted on the second printed circuit board 52. The second printed circuit board 52 is slantwise attached on a corresponding inclined face 42 of the protruding block 40, and the second LED 54 is disposed slantwise relative to the supporting plate 12.

The second envelope 70 has a tubular shape with a through hole (not labeled) defined therein. Two opposite ends of the second envelope 70 each have a diameter similar to that of the first groove 160 of the heat sink 10. A bottom end of the second envelope 70 is fixed to the top face of the supporting plate 12 defining the first groove 160 and engages with the sealing cushion 100, whereby a hermetical connection between the bottom end of the envelope 70 and the supporting plate 12 of the heat sink 10 is attained. The second envelope 70 is made of a transparent or semitransparent material such as glass, plastic, etc., for allowing light emitted by the second LED modules 50 passing therethrough.

A hollow mounting member 17 is disposed on a top end of the second envelope 70. The hollow mounting member 17 defines a receiving chamber 173 for accommodating a driving module 200 therein. The second envelope 70 is sandwiched uprightly between the supporting plate 12 of the heat sink 10 and the mounting member 17. Two safety connectors 18 are further provided to the mounting member 17 for allowing the electrical wires to extend therethrough and into/out the receiving chamber 173. The mounting member 17 comprises a cylindrical main body 170 which defines an opening (not labeled) at a top thereof and a cover 171 disposed on the main body 170 and sealing the opening. The cover 171 is connected to the main body 170 via a sealing cushion 100 for protecting the driving module 200 received in the mounting member 17 from moisture and dust. The main body 170 comprises a circular bottom wall (not labeled) and a cylindrical sidewall (not labeled) extending perpendicularly and upwardly from an outer periphery of the bottom wall. A connecting hole 172 is defined at a center of the bottom wall for the electrical wires extending therethrough to connect with the second LED modules 50. A plurality of through apertures 1701 are defined in the bottom wall of the main body 170. A plurality of screwing members (not labeled) are correspondingly extended through the through apertures 1701 of the mounting member 17 and screwed into the heat sink 10. Two mounting holes (not labeled) are juxtaposedly defined in one side of the sidewall of the mounting member 17. The two safety connectors 18 are threadedly engaged in the mounting holes, respectively.

The safety connector 18 is tubular and defines a central hole (not labeled) corresponding to the mounting hole for extension of the electrical wires. A cutout 182 is defined in one side of the safety connector 18 for receiving a pressing piece 184 therein. The cutout 182 communicates with the central hole (not labeled) for exposing a portion of the electrical wires received in the safety connector 18. The pressing piece 184 is arced, and defines two fixing holes (not labeled) at two opposite ends thereof. The pressing piece 184 is connected to the safety connector 18 via bolts (not shown) extending through the fixing holes thereof and screwing into the safety connector 18.

The pressing piece 184 tightly secures the electric wires against an inner face of the safety connector 18, whereby the electrical wires are reliably held in the central hole of the safety connector 18 via the pressing piece 184.

A fixing bracket 300 is disposed on the cover 171 of the mounting member 17. The fixing bracket 300 is an elongated and bended sheet, and comprises an upright U-shaped fixing portion (not labeled) which is fixed on the cover 171 and two arms (not labeled) extending outwardly and horizontally from two opposite sides of the fixing portion. In use, the LED lamp can be fixed to a wall or a ceiling via the fixing bracket 300.

In assembly, the first LED module 20 is mounted on the bottom face of the supporting plate 12; the second LED modules 50 are correspondingly attached to the inclined faces 42 of the protruding blocks 40; the engaging flange 62 of the first envelope 60 is hermetically connected to the bottom face of the supporting plate 12 defining the receiving groove 120 of the heat sink 10 to receive the first LED module 20 therein; the second envelope 70 is hermetically sandwiched between the heat sink 10 and the mounting member 17 to thereby receive the second LED modules 50 therein; the pressing frame 90 is disposed on the first envelope 60 and fixed to the heat sink 10 to press the first envelope 60 against the heat sink 10, wherein the protruding tabs 94 of the pressing frame 90 horizontally protrude out of the engaging flange 62 and located just below the protruding ribs 126, respectively; the protecting cage 80 surrounds an outer periphery of the first envelope 60 with the pressing flange 82 thereof securely fixed to the pressing frame 90.

The above-described LED lamp can be applied in various occasions to meet large-area illumination requirements thereof. For example, the LED lamp could be secured to a ceiling via the fixing bracket 300. The light generated by the first LED module 20 is directly transmitted through the light-guiding module 30 and the first envelope 60 toward an area below the lamp, and projects outwardly. The lenses 42 of the light-guiding module 40 can exactly refract the light from the first LEDs 24 towards the predefined area to be illuminated, whereby utilization efficiency of the LED light source is enhanced. The protruding blocks 40 have the inclined faces 42 oriented outwardly and upwardly, away from the top face of the supporting plate 12, on which the second LED modules 50 are mounted. Accordingly, light emitted by the second LED modules 50 is radiated upwardly and outwardly and thus distributed over a large region. Thus, the first and second LED modules 20, 50 of the LED lamp can generate light that radiate along multiple directions, i.e., along the downward direction and the laterally upward direction, to thereby provide a large-area illumination. Thus, the LED lamp in accordance with present disclosure can have a large illumination area. In addition, when the first and second LED modules 20, 50 emit light, heat generated by the first LEDs 24 is absorbed by the heat sink 10, and heat generated by the second LEDs 54 is absorbed by the protruding blocks 40, and then transferred to the heat sink 10. Finally, the heat is dispersed into ambient air via the fins 14.

It is to be understood, however, that even though numerous characteristics and advantages of the disclosure have been set forth in the foregoing description, together with details of the structure and function of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED lamp comprising:

a heat sink comprising a supporting plate;

a plurality of LEDs mounted on the supporting plate, and the LEDs comprising a plurality of first LEDs disposed on a bottom face of the supporting plate and a plurality of second LEDs; and a plurality of protruding blocks extending upwardly from a top face of the supporting plate, and each of the protruding blocks having an inclined face oriented upwardly and outwardly away from the top face of the supporting plate;

wherein the second LEDs are disposed on the inclined faces of the protruding blocks, whereby at least a portion of light generated from the second LEDs projects towards a lateral side of the LED lamp.

2. The LED lamp as described in claim 1, wherein an acute intersection angle is formed between each inclined face and the top face of the supporting plate.

3. The LED lamp as described in claim 1, wherein the inclined faces face radially and outwardly relative to a center of the supporting plate.

4. The LED lamp as described in claim 1, wherein the inclined faces are centrosymmetrical relative to a center of the supporting plate.

5. The LED lamp as described in claim 1, wherein each of the protruding blocks is wedge-shaped.

6. The LED lamp as described in claim 5, wherein each of the protruding blocks has a configuration like a triangular prism.

7. The LED lamp as described in claim 1 further comprising a mounting member for receiving a driving module therein.

8. The LED lamp as described in claim 7 further comprising a tubular second envelope disposed on the top face of the supporting plate and enclosing the second LEDs and the protruding blocks therein, wherein the second envelope is hermetically sandwiched between the supporting plate and the mounting member.

9. The LED lamp as described in claim 1, wherein an annular receiving groove is recessed from a periphery of the bottom face of the supporting plate, a sealing gasket being received in the annular receiving groove.

10. The LED lamp as described in claim 9 further comprising a first envelope which comprises a bowl-shaped body and an engaging flange extending outwardly from a periphery of the body, and the engaging flange is fixed to the bottom face of the supporting plate of the heat sink defining the receiving groove.

11. The LED lamp as described in claim 10 further comprising an annular pressing frame disposed on the engaging flange of the first envelope for securing the first envelope to the heat sink.

12. The LED lamp as described in claim 10 further comprising a protecting cage covering an outer face of the first envelope, the protecting cage comprising a plurality of wires interlaced with each other.

13. The LED lamp as described in claim 1, wherein the light emitted from the first LEDs is radiated downwardly and the light emitted from the second LEDs is radiated also upwardly.

14. The LED lamp as described in claim 1 further comprising a light-guiding module disposed over the first LEDs, the light-guiding module comprising a plurality of lenses each disposed over one of the first LEDs and a securing board securing the lenses in position over the first LEDs.

* * * * *